US009059522B2

(12) United States Patent
Spalding et al.

(10) Patent No.: US 9,059,522 B2
(45) Date of Patent: Jun. 16, 2015

(54) WEDGE CONNECTOR ASSEMBLIES AND METHODS FOR CONNECTING ELECTRICAL CONDUCTORS USING SAME

(71) Applicant: Tyco Electronics Corporation, Berwyn, PA (US)

(72) Inventors: Matthew Spalding, Cornelius, NC (US); Richard Heavner, Apex, NC (US); Terry Edward Frye, Cary, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/095,716

(22) Filed: Dec. 3, 2013

(65) Prior Publication Data

US 2014/0170892 A1 Jun. 19, 2014

Related U.S. Application Data

(60) Provisional application No. 61/736,783, filed on Dec. 13, 2012.

(51) Int. Cl.

| | |
|---|---|
| ***H01R 4/50*** | (2006.01) |
| ***H01R 4/48*** | (2006.01) |
| ***H01R 43/26*** | (2006.01) |

(52) U.S. Cl.

CPC ..... *H01R 4/489* (2013.01); *H01R 43/26* (2013.01); *Y10T 29/49208* (2015.01)

(58) Field of Classification Search

CPC .. H01R 4/5083; H01R 4/5091; H01R 4/5025; H01R 4/5033; H01R 4/44; H01R 4/50; H01R 4/5008; F16G 11/04

See application file for complete search history.

(56) References Cited

U.S. PATENT DOCUMENTS

| | | | | |
|---|---|---|---|---|
| 3,290,746 | A * | 12/1966 | Broske | 403/178 |
| 3,345,454 | A | 10/1967 | Mixon, Jr. | |
| 3,515,794 | A | 6/1970 | Beinhaur et al. | |
| 3,681,512 | A | 8/1972 | Werner et al. | |
| 3,742,582 | A | 7/1973 | Broske | |
| 3,761,602 | A | 9/1973 | De Sio et al. | |
| 3,826,860 | A | 7/1974 | De Sio et al. | |
| 4,252,992 | A | 2/1981 | Cherry et al. | |
| 4,279,461 | A | 7/1981 | Bussen et al. | |

(Continued)

OTHER PUBLICATIONS

"General Catalog", Grupo Intelli, www.grupointelli.com IntMKT Set/2009, Jan. 2009, 52 pages.

(Continued)

*Primary Examiner* — Gary Paumen

(74) *Attorney, Agent, or Firm* — Myers Bigel Sibley & Sajovec, PA

(57) ABSTRACT

A wedge connector assembly for forming an electrical connection with first and second electrical conductors includes a coupling portion, first and second resilient spring sleeve portions located on the coupling portion, a first wedge member and a second wedge member. The first spring sleeve portion defines a first sleeve cavity tapering in a first direction away from the second spring sleeve portion and the second spring sleeve portion defines the second sleeve cavity tapering in a second direction away from the first spring sleeve portion. The first wedge member is configured to be forcibly driven into the first sleeve cavity in the first direction to capture the first conductor and the second wedge member is configured to be forcibly driven into the second sleeve cavity in the second direction to thereby capture the second conductor.

21 Claims, 6 Drawing Sheets

(56) References Cited

U.S. PATENT DOCUMENTS

| | | | | |
|---|---|---|---|---|
| 4,722,189 | A | 2/1988 | Center | |
| 4,752,252 | A | 6/1988 | Cherry et al. | |
| RE33,098 | E | 10/1989 | Center | |
| 5,090,923 | A | 2/1992 | Kenyon et al. | |
| 5,244,422 | A | 9/1993 | Laricchia | |
| 5,538,447 | A | 7/1996 | Chadbourne et al. | |
| 5,600,096 | A | 2/1997 | Cherry et al. | |
| 5,683,273 | A | 11/1997 | Garver et al. | |
| 5,774,987 | A | 7/1998 | Chadbourne et al. | |
| 5,794,334 | A | 8/1998 | Chadbourne et al. | |
| 5,862,589 | A | 1/1999 | Chadbourne et al. | |
| 6,093,064 | A | 7/2000 | Callen et al. | |
| 6,817,909 | B2 * | 11/2004 | Dobrinski et al. | 439/783 |
| 6,851,262 | B1 | 2/2005 | Gregory et al. | |
| 6,895,663 | B2 | 5/2005 | Itrich | |
| 6,979,236 | B1 * | 12/2005 | Stanton | 439/783 |
| 7,426,782 | B2 | 9/2008 | Johnson et al. | |
| 7,819,706 | B2 * | 10/2010 | Copper et al. | 439/783 |
| 8,608,517 | B2 | 12/2013 | La Salvia et al. | |
| 2003/0148671 | A1 * | 8/2003 | Mello et al. | 439/783 |
| 2004/0029455 | A1 | 2/2004 | Johnson et al. | |
| 2004/0203294 | A1 * | 10/2004 | Mello et al. | 439/783 |
| 2006/0148333 | A1 * | 7/2006 | Peterson | 439/783 |
| 2006/0148334 | A1 * | 7/2006 | Conn et al. | 439/783 |
| 2008/0026644 | A1 * | 1/2008 | De France et al. | 439/783 |
| 2010/0003864 | A1 * | 1/2010 | Fuzetti et al. | 439/783 |
| 2010/0314232 | A1 | 12/2010 | Gregory et al. | |

OTHER PUBLICATIONS

"Ready reference Guide", Tyco Electronics, Energy Division, http://energy.tycoelectronics.com, 143 pages, published at least as early as Sep. 2011.

"U.D.C.—Universal Distribution Connector Reinforced", Tyco Electronics Catalog 125003, Revised Mar. 19999, 8 pages.

Customer Manual, *AMPACT Taps, Stirrups, and Application Tooling*, 409-2106, Rev M, Feb. 5, 1999, 39 pages.

Dribo, spol. s r.o., "Automatic connectors Reliable", Oct. 2003, 4 pages.

* cited by examiner

WEDGE CONNECTOR ASSEMBLIES AND METHODS FOR CONNECTING ELECTRICAL CONDUCTORS USING SAME

RELATED APPLICATIONS(S)

The present application claims the benefit of and priority from U.S. Provisional Patent Application Ser. No. 61/736,783, filed Dec. 13, 2012, the disclosure of which is hereby incorporated herein in its entirety.

FIELD OF THE INVENTION

The present invention relates to connectors and, more particularly, to power electrical connectors and methods and connections including the same.

BACKGROUND OF THE INVENTION

Utility firms constructing, operating and maintaining overhead and/or underground power distribution networks and systems utilize connectors to join electrical cables such as high voltage electrical power distribution and transmission lines. In some cases, it is necessary or desirable to form a tension splice between two conductors (e.g., across a pre-existing connector). Automatic connectors are commonly used for this purpose, but may suffer from a number of problems relating to preparation, reliability and performance.

SUMMARY OF THE INVENTION

According to embodiments of the present invention, a wedge connector assembly for forming an electrical connection with first and second electrical conductors includes a coupling portion, first and second resilient spring sleeve portions located on the coupling portion, a first wedge member and a second wedge member. The first spring sleeve portion defines a first sleeve cavity and a first conductor channel configured to receive the first conductor. The second spring sleeve portion defines a second sleeve cavity and a second conductor channel configured to receive the second conductor. The first sleeve cavity tapers in a first direction away from the second spring sleeve portion and the second sleeve cavity tapers in a second direction away from the first spring sleeve portion. The first wedge member is configured to be forcibly driven into the first sleeve cavity in the first direction to thereby capture the first conductor in the first conductor channel between the first spring sleeve portion and the first wedge member. The second wedge member is configured to be forcibly driven into the second sleeve cavity in the second direction to thereby capture the second conductor in the second conductor channel between the second spring sleeve portion and the second wedge member.

According to method embodiments of the present invention, a method for forming an electrical connection with first and second electrical conductors includes providing a coupling portion and first and second resilient spring sleeve portions located on the coupling portion. The first spring sleeve portion defines a first sleeve cavity and a first conductor channel configured to receive the first conductor. The second spring sleeve portion defines a second sleeve cavity and a second conductor channel configured to receive the second conductor. The first sleeve cavity tapers in a first direction away from the second spring sleeve portion and the second sleeve cavity tapers in a second direction away from the first spring sleeve portion. The method further includes: mounting the first conductor in the first conductor channel; forcibly driving a first wedge member into the first sleeve cavity in the first direction and thereby capturing the first conductor in the first conductor channel between the second spring sleeve portion and the second wedge member; mounting the second conductor in the second conductor channel; and forcibly driving a second wedge member into the second sleeve cavity in the second direction and thereby capturing the second conductor in the second conductor channel between the second spring sleeve portion and the second wedge member.

According to embodiments of the present invention, an electrical connection between first and second electrical conductors includes a first electrical conductor, a second electrical conductor, and a wedge connector assembly. The wedge connector assembly includes a coupling portion, first and second resilient spring sleeve portions located on the coupling portion, a first wedge member, and a second wedge member. The first spring sleeve portion defines a first sleeve cavity and a first conductor channel, an engagement section of the first conductor being disposed in the first conductor channel. The second spring sleeve portion defines a second sleeve cavity and a second conductor channel, an engagement portion of the second conductor being disposed in the second conductor channel. The first sleeve cavity tapers in a first direction away from the second spring sleeve portion and the second sleeve cavity tapers in a second direction away from the first spring sleeve portion. The first wedge member is forcibly driven into the first sleeve cavity in the first direction and captures the first conductor in the first conductor channel between the first spring sleeve portion and the first wedge member. The second wedge member is forcibly driven into the second sleeve cavity in the second direction captures the second conductor in the second conductor channel between the second spring sleeve portion and the second wedge member.

According to embodiments of the present invention, an electrical connection between first and second electrical conductors includes first and second electrical conductors and a wedge connector assembly. The first electrical conductor has a first rated break strength and a second electrical conductor has a second rated break strength. The wedge connector assembly includes at least one resilient spring sleeve member and at least one wedge member. The at least one resilient spring sleeve member defines first and second conductor channels. The first and second conductors are disposed in the first and second conductor channels, respectively, and captured therein between the at least one resilient spring sleeve member and the at least one wedge member to form a mechanical tension splice connection between the wedge connector assembly and each of the first and second conductor. The mechanical tension splice connection has a rated pull out strength that is at least 70% of each of the first and second rated break strengths.

Further features, advantages and details of the present invention will be appreciated by those of ordinary skill in the art from a reading of the figures and the detailed description of the embodiments that follow, such description being merely illustrative of the present invention.

DETAILED DESCRIPTION OF EMBODIMENTS OF THE INVENTION

Figure 1:
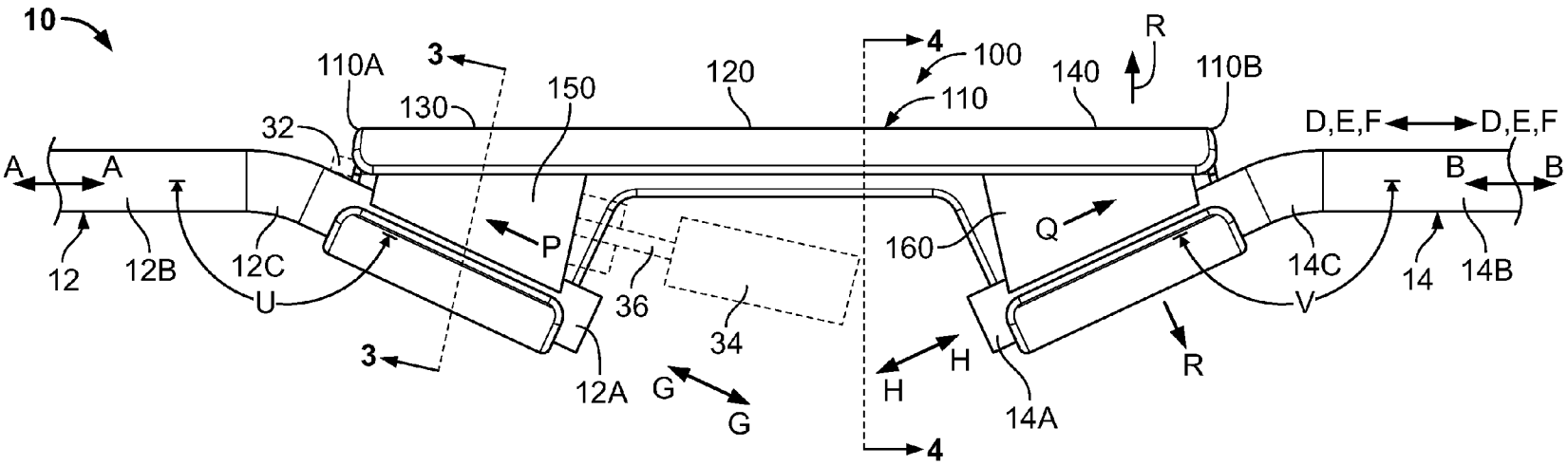
FIG. 1 is a side view of an electrical connection including a wedge connector assembly according to embodiments of the present invention.
Figure 2:
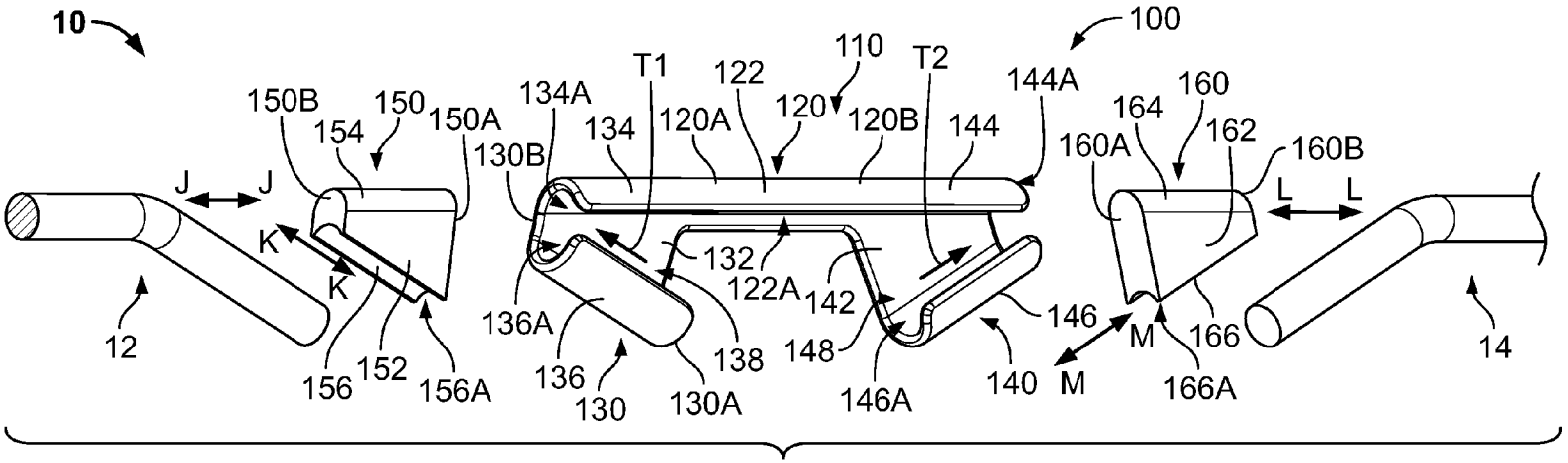
FIG. 2 is an exploded view of the electrical connection of FIG. 1.
Figure 4:
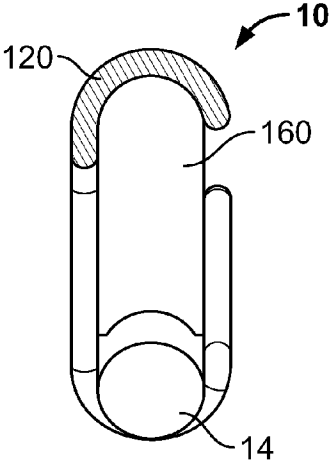
FIG. 4 is a cross-sectional view of the electrical connection of FIG. 1 taken along the line 4-4 of FIG. 1.
Figure 3:
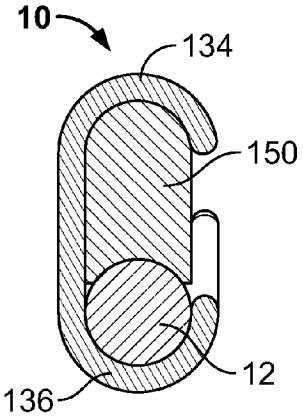
FIG. 3 is a cross-sectional view of the electrical connector of FIG. 1 taken along the line 3-3 of FIG. 1.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

As used herein, "monolithic" means an object that is a single, unitary piece formed or composed of a material without joints or seams.

With reference to FIGS. 1-5, a wedge connector assembly 100 according to embodiments of the present invention is shown therein. The wedge connector assembly 100 may be used to form an electrical connection 10 between a pair of elongate electrical cables or conductors 12, 14. According to some embodiments, the connection 10 is a tension splice. In some embodiments, the connection 10 is formed about a preinstalled or pre-existing connection 20 (including a connector 22) between the conductors 12, 14. The wedge connector assembly 100 may be installed using a tool assembly 30 (shown in dashed lines in FIG. 1).

The conductors 12, 14 may be any suitable electrically conductive conductors with at least engagement sections 12A, 14A thereof being exposed to enable electrical contact. According to some embodiments, one or both of the conductors 12, 14 include a plurality of elongate strands. According to some embodiments, one or both of the conductors 12, 14 are solid. According to some embodiments, the conductors 12, 14 are flexible or bendable. The conductor 12 has a main section 12B having a conductor axis A-A. The conductor 14 has a main section 14B having a conductor axis B-B.

The tool assembly 30 may be any suitable tool for installing a connector assembly as described herein. According to some embodiments, the tool assembly 30 is an explosive powder actuated tool. In some embodiments, the tool assembly 30 is an electrically powered tool. The exemplary tool assembly 30 includes an anvil or tool head 32, a drive mechanism 34 (e.g., an explosively actuated tool or an electrically powered driver), and a ram 36. Examples of suitable tool assemblies are disclosed in U.S. Pat. No. 6,851,262 to Gregory et al.

The wedge connector assembly 100 includes a spring coupling unit 110, a left wedge member 150, and a right wedge member 160. Components and features are referred to herein as "left" and "right" for the purposes of explanation only.

The spring coupling unit 110 has opposed ends 110A and 110B. The spring coupling unit 110 includes a coupling portion 120, a resilient left spring sleeve portion 130, and a resilient right spring sleeve portion 140. According to some embodiments, the spring coupling unit 110 is unitary. According to some embodiments, the unit 110 is monolithic. In some embodiments, the unit 110 is integrally and unitarily formed. According to some embodiments, the unit 110 is rigid.

The spring coupling unit 110 may be formed of any suitable material. According to some embodiments, the unit 110 is formed of metal. In some embodiments, the unit 110 is formed of aluminum or copper. The unit 110 may be formed in any suitable manner. According to some embodiments, the unit 110 is stamped (e.g., die cut), formed, machined and/or cast.

The coupling portion 120 has opposed ends 120A and 120B and an arcuate wall 122 extending from end 120A to end 120B. The wall 122 defines a channel 122A. The sleeve portion 130 is integrally formed with or affixed to the end 120A. The sleeve portion 140 is integrally formed with or affixed to the 120B.

The spring sleeve portion 130 includes a body 132 and opposed upper and lower arcuate side walls 134 and 136 extending along the opposed side edges of the body 132. The sleeve portion 130 defines a cavity 138 including an upper channel 134A (defined by the side wall 134) and an opposing lower channel 136A (defined by the side wall 136). The sleeve portion 130 and the cavity 138 taper inwardly in a direction T1 from an inner end 130A to an outer end 130B. The direction T1 is away from the sleeve portion 140.

The spring sleeve portion 140 includes a body 142 and opposed upper and lower arcuate side walls 144 and 146 extending along the opposed side edges of the body 142. The sleeve portion 140 defines a cavity 148 including an upper channel 144A (defined by the side wall 144) and an opposing lower channel 146A (defined by the side wall 146). The sleeve portion 140 and the cavity 148 taper inwardly in a direction T2 from an inner end 140A to an outer end 140B. The taper direction T2 is generally (but not necessarily directly) opposite the taper direction T1, and is away from the sleeve portion 130.

The wedge member 150 includes a body 152 having opposing, arcuate side walls 154 and 156. The upper side wall 154 is convex and the lower side wall 156 is concave and defines a groove or channel 156A. The wedge member 150 tapers inwardly in a direction from an inner end 150A to an outer end 150B.

The wedge member 160 includes a body 162 having opposing, arcuate side walls 164 and 166. The upper side wall 164 is convex and the lower side wall 166 is concave and defines a groove or channel 166A. The wedge member 160 tapers inwardly in a direction from an inner end 160A to an outer end 160B.

The wedge members 150, 160 may be formed of any suitable material and using any suitable technique. According to some embodiments, the wedge members 150, 160 are formed of metal and, in some embodiments, aluminum or copper. According to some embodiments, the wedge members 150, 160 are cast and/or machined.

With reference to FIG. 1, the spring coupling unit 110 and the channel 122A thereof each define a unit axis D-D. The channel 134A defines an axis E-E, the channel 144A defines an axis F-F, the channel 136A defines an axis G-G, and the channel 146A defines an axis H-H. With references to FIG. 2, the wedge side wall 154 defines an axis J-J, the wedge groove 156A defines an axis K-K, the wedge side wall 164 defines an axis L-L, and the wedge groove 166A defines an axis M-M.

The axes J-J and K-K form an oblique included angle therebetween, and the axes L-L and M-M likewise form an oblique included angle therebetween. According to some embodiments, these oblique included angles are in the range of from about 160 to 175 degrees and, in some embodiments, from 167 to 171 degrees.

The wedge connector assembly 100 may be used as follows in accordance with the embodiments of the present invention. The conductor section 12A is placed in the channel 134A with the conductor section 12B extending away from the end 110A of the spring coupling unit 110. The wedge member 150 is partially installed in the cavity 138 with the outer end 150B facing the outer end 130B, the upper side wall 154 received in the channel 134A and the channel 156A receiving the conductor section 12A. The wedge member 150 may be forced into the sleeve portion 130 by hand or using a hammer or the like to temporarily hold the wedge member 150 and the conductor section 12A in position.

The tool head 32 of the tool assembly 30 is mounted on the wedge connector assembly 100 as shown in FIG. 1 in dashed lines. The angled orientation of the wedge member 150 with respect to the coupling portion 120 can provide space or clearance for mounting and/or operating the tool assembly 30. The drive mechanism 34 is actuated (e.g., fired or powered) to drive the ram 36 into the wedge member 150. The wedge member 150 is thereby forcibly driven outwardly in a forward direction P (generally the same as the cavity taper direction T1 and away from the sleeve portion 140) relative to the sleeve portion 130 to a final position as shown in FIG. 1 to capture the conductor section 12A between the side wall 156 and the side wall 136. Interference fits are formed between the conductor section 12A and the engaging surfaces of the walls 156, 136 and between the wedge side wall 154 and the side wall 134. The conductor 12 is thereby mechanically and electrically connected to the wedge connector assembly 100. The wedge member 150, the sleeve portion 130 and/or the conductor section 12A may be deformed. According to some embodiments, the sleeve portion 130 is elastically deformed so that the side walls 134, 136 are deflected or displaced in divergent outward directions R (FIG. 1) and apply a persistent bias or spring force against the wedge member 150 and the conductor section 12A.

The conductor engagement section 14A is then mounted in the channel 146. The wedge member 160 is installed in the sleeve portion 140 (in the same manner as described above for the wedge member 150) to capture the conductor section 14A and mechanically and electrically connect the conductor 14 to the wedge connector assembly 100, and to thereby mechanically and electrically connect the conductors 12 and 14 to one another. More particularly, the wedge member 160 is forcibly driven outwardly using the tool assembly 30 in a forward direction Q (generally the same as the cavity taper direction T2) relative to the sleeve portion 140 to a final position as shown in FIG. 1. The direction Q is away from the sleeve portion 130 and opposite the direction P.

Figure 5:
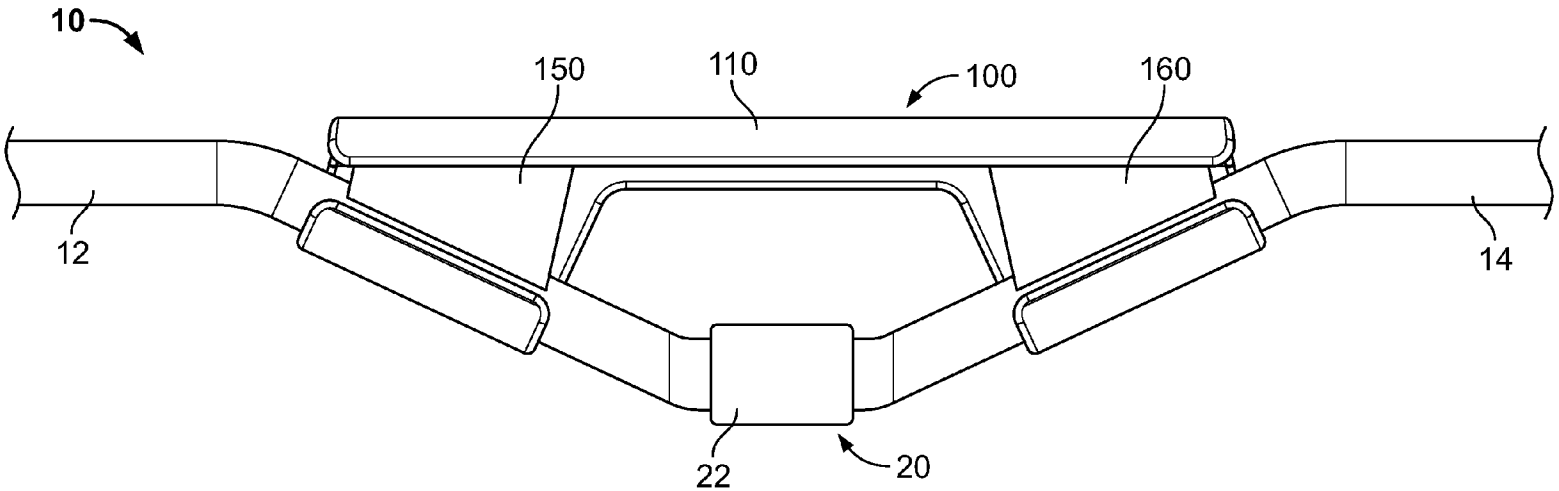
FIG. 5 is a side view of an alternate connection wherein the connection of FIG. 1 is formed around a pre-existing connection.

According to some embodiments, the connection 10 is a tension splice wherein the conductors 12 and 14 exert opposing pulling loads on the wedge connector assembly 100 that place the wedge connector assembly 100 in tension. According to some embodiments, the connection 10 is a straight or in-line tension splice (e.g., a main run butt splice). The wedge connector assembly 100 can be installed and the connection 10 can extend or be formed around an existing connector 22 as shown in FIG. 5. The existing connector 22 can instead be cut out before or after installing the wedge connector assembly 100. The conductors 12, 14 can be in tension during the steps of installing the wedge members 150, 160 to capture the conductor sections 12A, 14A. According to some embodiments, the wedge connector assembly 100 can be used to take up length of a single conductor to thereby reduce sag in the conductor.

The configuration of the wedge connector assembly 100 can provide the connection 10 with a high pullout strength, enabling the connection 10 to withstand high tension loads on the conductors 12 and 14 without the conductor sections 12A and 14A being pulled out from the sleeve portions 130 and 140. Because the sleeve portion 130 and the wedge member 150 are tapered in the direction of the tension load of the conductor 12, the pullout force from the conductor 12 tends to pull the wedge member 150 in the direction P and thereby into a tighter engagement with the sleeve portion 130 and the conductor section 12A. Likewise, because the sleeve portion 140 and the wedge member 160 are tapered in the direction of the tension load of the conductor 14, the pullout force from the conductor 14 tends to pull the wedge member 160 in the direction Q and thereby into tighter engagement with the sleeve portion 140 and the conductor section 14A.

As can be seen in FIG. 1, with the conductors 12, 14 in tension, a bend 12C, 14C is formed between each conductor main section 12B, 14B and the corresponding conductor engagement section 12A, 14A. The wedge connector assembly 100 is configured such that, when the conductors 12, 14 are in tension sufficient to place their axes A-A and B-B in near or substantially parallel alignment, an angle U is defined between the conductor axis A-A and the channel axis G-G (which is generally the same as the axis of the conductor section 12A) and an angle V is defined between the conductor axis B-B and the channel axis H-H (which is generally the same as the axis of the conductor section 14A). According to some embodiments, each angle U, V is at least 160 degrees and, in some embodiments, in the range of from about 167 to 171 degrees. In this manner, the pullout strengths of the connections are increased. According to some embodiments, the outer edges of the sleeve sections 130, 140 are rounded to reduce the risk of strand breakage in or damage to the conductors 12, 14.

Figure 6:
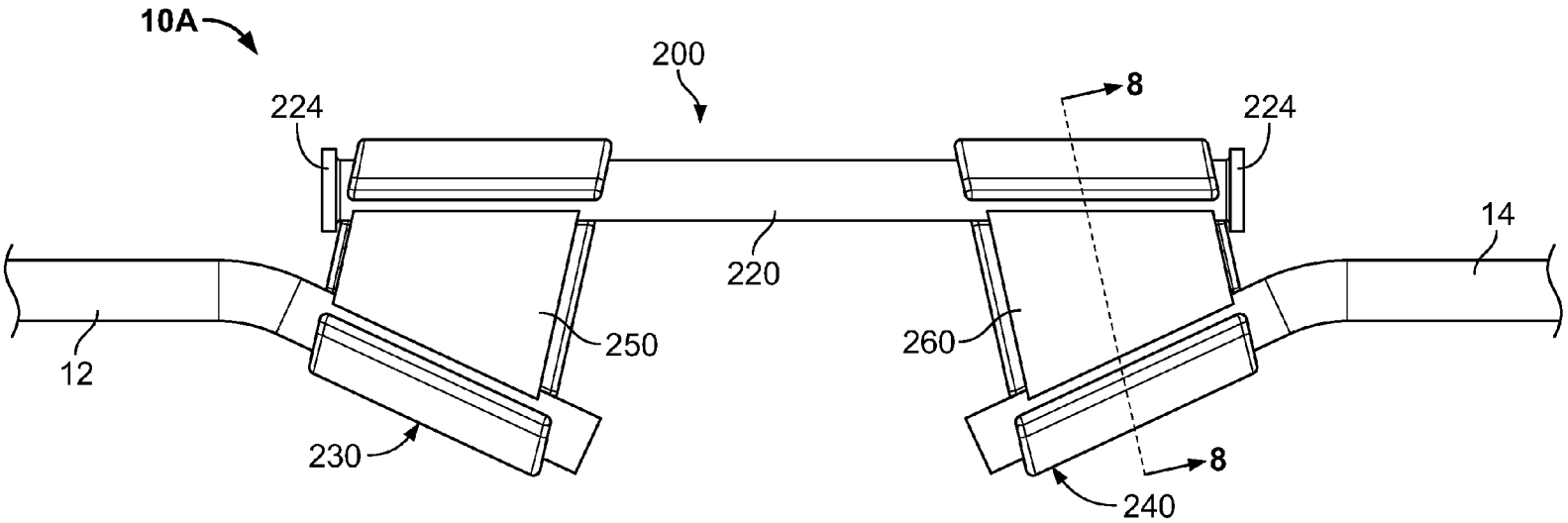
FIG. 6 is a side view of an electrical connection including a wedge connector assembly according to further embodiments of the present invention.
Figure 7:
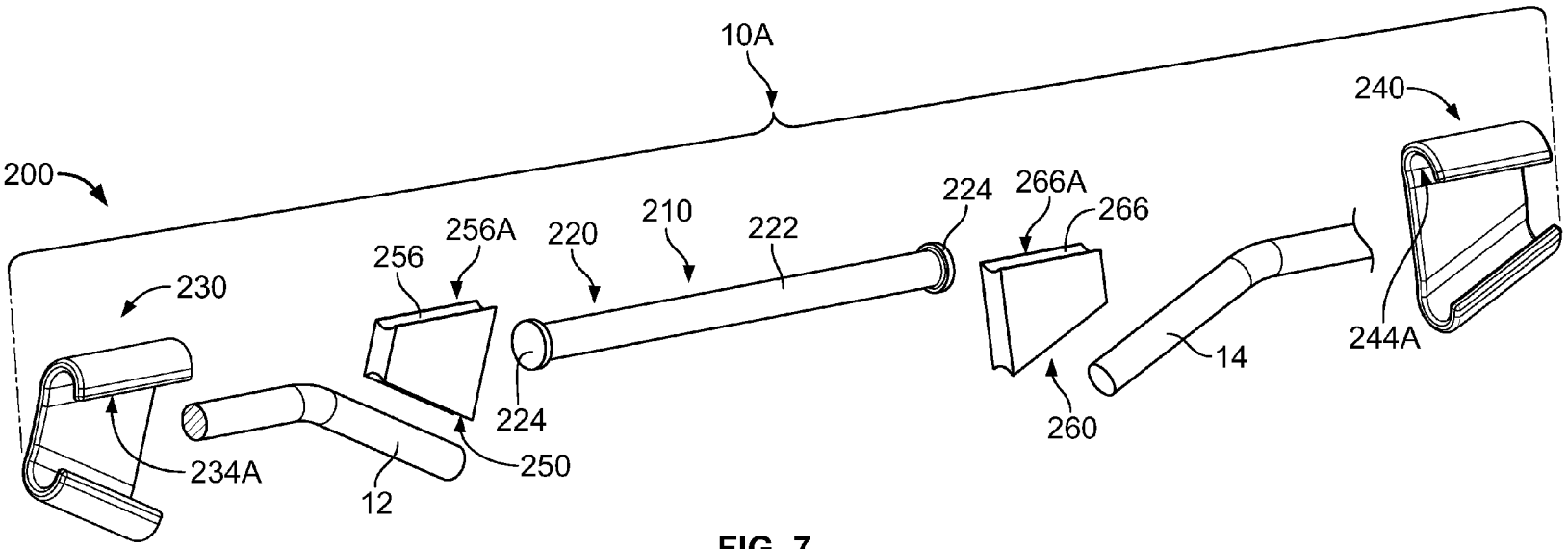
FIG. 7 is an exploded view of the wedge connector assembly of FIG. 6.
Figure 8:
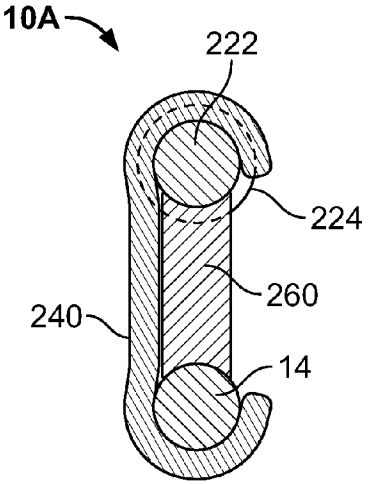
FIG. 8 is a cross-sectional view of the wedge connector assembly of FIG. 6 taken along the line 8-8 of FIG. 6.

With reference to FIGS. 6-8, a connection 10A including a wedge connector assembly 200 according to further embodiments of the present invention is shown therein. The wedge connector assembly 200 includes a spring coupling assembly 210, a wedge member 250 and a wedge member 260.

The spring coupling assembly 210 includes a coupling member or rod 220, a spring sleeve member 230 and a spring sleeve member 240. The rod 220 includes a rigid rod body 222 and opposed stop features 224 on each end of the rod body 222.

The spring sleeve members 230 and 240 generally correspond to the sleeve portions 130 and 140 except that the sleeve members 230 and 240 are not affixed to a common coupling portion. Instead, these sleeve members 230 and 240 are mounted on opposed ends of the rod body 222 such that the rod body 222 is received in upper channels 234A and 244A. In some embodiments, the rod body 222 is slidable in the channels 234A, 244A until the wedge members 250, 260 are secured.

The wedge members 250, 260 generally correspond to the wedge members 150, 160 except that the upper convex walls 154, 164 are replaced with concave walls 256, 266 defining channels 256A, 266A that receive the rod body 222.

The wedge connector assembly 200 can be installed on the conductors 12, 14 in the same manner as described above for the wedge connector assembly 100 to form the connection 10A. However, in the case of the connection 10A, the stop features 224 will limit outward travel of the spring sleeve members 230, 240.

Figure 9:
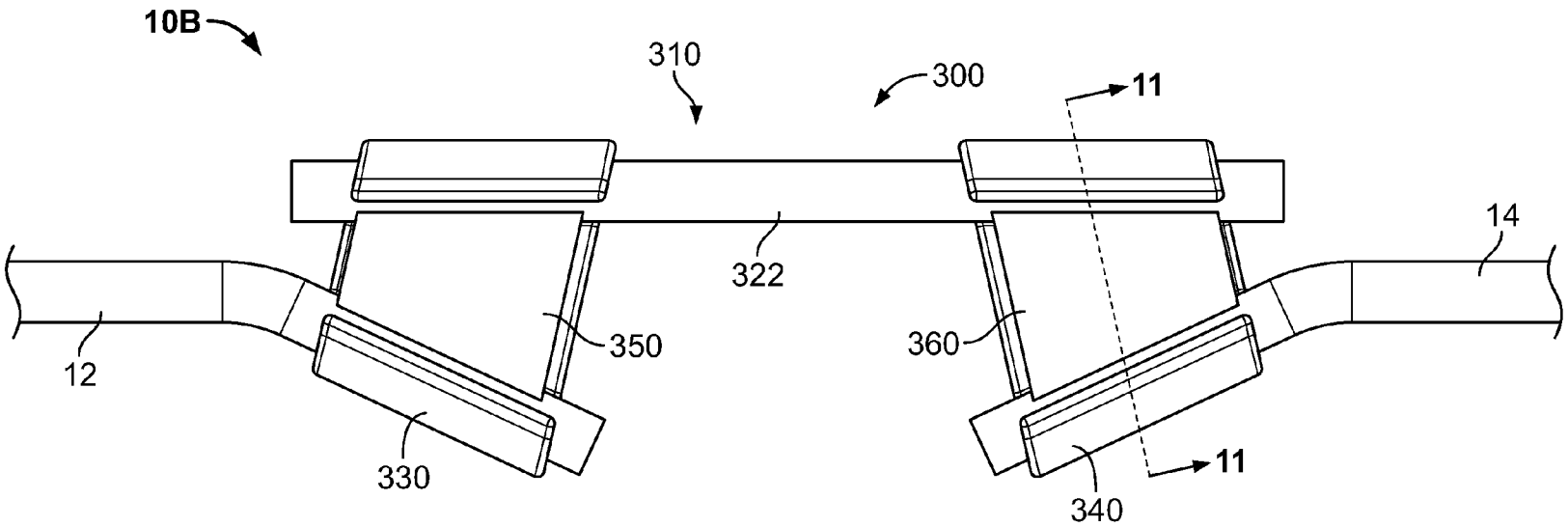
FIG. 9 is a side view of an electrical connection including a wedge connector assembly according to further embodiments of the present invention.
Figure 10:
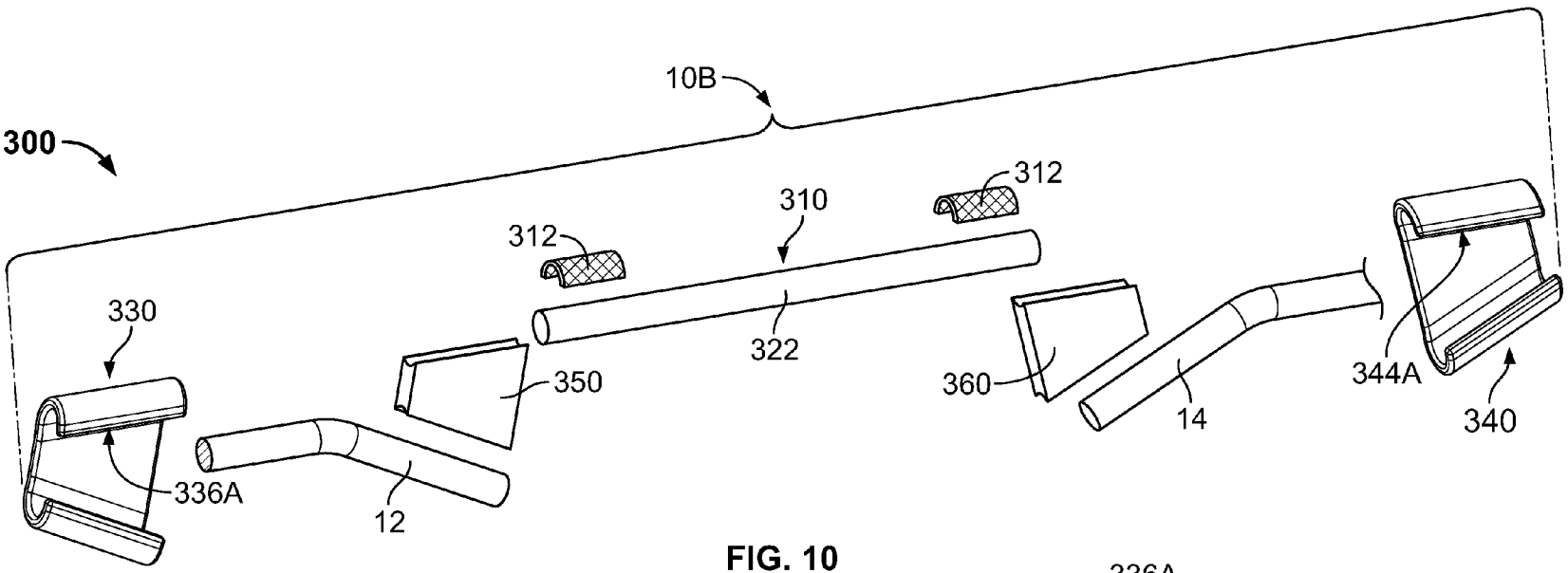
FIG. 10 is an exploded view of the wedge connector assembly of FIG. 9.
Figure 11:
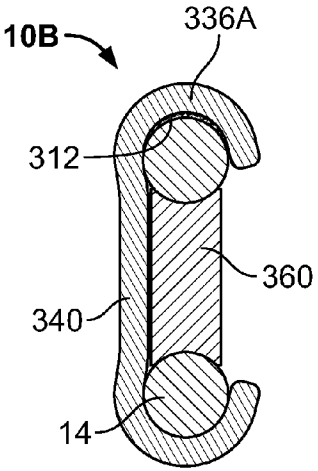
FIG. 11 is a cross-sectional view of the wedge connector assembly of FIG. 9 taken along the line 11-11 of FIG. 9.

With reference to FIGS. 9-11, a connection 10B including a wedge connector assembly 300 according to further embodiments of the invention is shown therein. The wedge connector assembly 300 includes a spring coupling assembly 310, a wedge member 350 and a wedge member 360. The spring coupling assembly 310, the wedge member 350 and the wedge member 360 are configured in the same manner as the spring coupling assembly 210, the wedge member 250 and the wedge member 260, except that the stop features 224 are omitted and the rod body 322 is affixed to the inner surfaces of the spring member channels 334A, 344A of the spring sleeve members 330 and 340 by welds 312. In the case of the connection 10B, the welds 312 will prevent outward travel of the spring sleeve members 330 and 340.

According to some embodiments, a mechanical tension splice connection formed using a wedge connection assembly according to embodiments of the present invention (e.g., the wedge connector assembly 100, 200 or 300) has a rated pullout strength that is at least 70 percent of the rated break strength of each of the conductors 12 and 14.

According to further embodiments, the spring sleeve portions or members can be affixed to a coupling portion or member by other techniques (e.g., bolted together). In some embodiments, the coupling portion is an electrically conductive, flexible wire or cable.

Embodiments of the present invention have been described above and, although specific terms are employed, they are used in a generic and descriptive sense only and not for purposes of limitation. The following claims are provided to ensure that the present application meets all statutory requirements as a priority application in all jurisdictions and shall not be construed as setting forth the scope of the present invention.

That which is claimed is:

1. A wedge connector assembly for forming an electrical connection with first and second electrical conductors, the wedge connector assembly comprising:

a coupling portion;

first and second resilient spring sleeve portions located on the coupling portion, wherein:

the first spring sleeve portion defines a first sleeve cavity and a first conductor channel configured to receive the first conductor;

the second spring sleeve portion defines a second sleeve cavity and a second conductor channel configured to receive the second conductor; and the first sleeve cavity tapers in a first direction away from the second spring sleeve portion and the second sleeve cavity tapers in a second direction away from the first spring sleeve portion;

a first wedge member configured to be forcibly driven into the first sleeve cavity in the first direction to thereby capture the first conductor in the first conductor channel between the first spring sleeve portion and the first wedge member; and a second wedge member configured to be forcibly driven into the second sleeve cavity in the second direction to thereby capture the second conductor in the second conductor channel between the second spring sleeve portion and the second wedge member.

2. The wedge connector assembly of claim 1 wherein:

the coupling portion has first and second opposed ends; and the first and second spring sleeve portions are located on the first and second ends of the coupling portion, respectively.

3. The wedge connector assembly of claim 1 wherein the first and second spring sleeve portions are integrally formed with the coupling member.

4. The wedge connector assembly of claim 1 wherein:

the coupling portion includes a rod having first and second opposed end portions and first and second stop features on the first and second ends, respectively;

the first spring sleeve portion includes a first sleeve member slidably mounted on the rod adjacent the first end thereof; and the second spring sleeve portion includes a second sleeve member slidably mounted on the rod adjacent the second end thereof;

wherein the first and second stop features limit movement of the first and second sleeve members.

5. The wedge connector assembly of claim 1 wherein:

the coupling portion includes a rod having first and second opposed end portions; and the first and second end portions are welded to the first and second spring sleeve portions, respectively.

6. The wedge connector assembly of claim 1 wherein the coupling portion includes a flexible electrical conductive coupling member.

7. The wedge connector assembly of claim 1 wherein the first and second directions are opposite one another.

8. A method for forming an electrical connection with first and second electrical conductors, the method comprising:

providing a coupling portion and first and second resilient spring sleeve portions located on the coupling portion, wherein:

the first spring sleeve portion defines a first sleeve cavity and a first conductor channel configured to receive the first conductor;

the second spring sleeve portion defines a second sleeve cavity and a second conductor channel configured to receive the second conductor; and the first sleeve cavity tapers in a first direction away from the second spring sleeve portion and the second sleeve cavity tapers in a second direction away from the first spring sleeve portion;

mounting the first conductor in the first conductor channel;

forcibly driving a first wedge member into the first sleeve cavity in the first direction and thereby capturing the first conductor in the first conductor channel between the second spring sleeve portion and the second wedge member;

mounting the second conductor in the second conductor channel; and forcibly driving a second wedge member into the second sleeve cavity in the second direction and thereby capturing the second conductor in the second conductor channel between the second spring sleeve portion and the second wedge member.

9. The method of claim 8 wherein forcibly driving the first wedge member into the first sleeve cavity includes forcibly driving the first wedge member into the first sleeve cavity using a tool.

10. The method of claim 9 wherein the tool is an explosive powder actuated tool.

11. The method of claim 8 wherein:

the first and second conductors are connected by a pre-installed connector; and the method includes capturing the first and second conductors in the first and second conductor channels, respectively, without disconnecting the first and second conductors from the pre-installed connector.

12. The method of claim 8 wherein the electrical connection is a tension splice between the first and second conductors.

13. The method of claim 12 wherein:

the first electrical conductor having a first rated break strength and a second electrical conductor having a second rated break strength; and the mechanical tension splice connection has a rated pull out strength that is at least 70% of each of the first and second rated break strengths.

14. The method of claim 8 wherein the first and second directions are opposite one another.

15. The method of claim 8 wherein:

the coupling portion has first and second opposed ends; and the first and second spring sleeve portions are located on the first and second ends of the coupling portion, respectively.

16. The method of claim 8 wherein the first and second spring sleeve portions are integrally formed with the coupling member.

17. The method of claim 8 wherein:

the coupling portion includes a rod having first and second opposed end portions and first and second stop features on the first and second ends, respectively;

the first spring sleeve portion includes a first sleeve member slidably mounted on the rod adjacent the first end thereof; and the second spring sleeve portion includes a second sleeve member slidably mounted on the rod adjacent the second end thereof;

wherein the first and second stop features limit movement of the first and second sleeve members.

18. The method of claim 8 wherein:

the coupling portion includes a rod having first and second opposed end portions; and the first and second end portions are welded to the first and second spring sleeve portions, respectively.

19. The method of claim 8 wherein the coupling portion includes a flexible electrical conductive coupling member.

20. The method of claim 8 wherein the first and second directions are opposite one another.

21. An electrical connection between first and second electrical conductors, the electrical connection comprising:

a first electrical conductor and a second electrical conductor;

a wedge connector assembly including:

a coupling portion;

first and second resilient spring sleeve portions located on the coupling portion, wherein:

the first spring sleeve portion defines a first sleeve cavity and a first conductor channel, an engagement section of the first conductor being disposed in the first conductor channel;

the second spring sleeve portion defines a second sleeve cavity and a second conductor channel, an engagement portion of the second conductor being disposed in the second conductor channel; and the first sleeve cavity tapers in a first direction away from the second spring sleeve portion and the second sleeve cavity tapers in a second direction away from the first spring sleeve portion;

a first wedge member forcibly driven into the first sleeve cavity in the first direction and capturing the first conductor in the first conductor channel between the first spring sleeve portion and the first wedge member; and a second wedge member forcibly driven into the second sleeve cavity in the second direction capturing the second conductor in the second conductor channel between the second spring sleeve portion and the second wedge member.

* * * * *